United States Patent [19]

Shakib

[11] 4,347,006

[45] Aug. 31, 1982

[54] PAPER INSERT AND LINE FEED MECHANISM

[75] Inventor: Iraj D. Shakib, Lexington, Ky.

[73] Assignee: International Business Machines Corporation, Armonk, N.Y.

[21] Appl. No.: 211,996

[22] Filed: Dec. 1, 1980

[51] Int. Cl.[3] ..... B41J 11/36; B41J 23/34

[52] U.S. Cl. ..... 400/187; 400/568; 400/569; 400/577; 400/611; 192/28

[58] Field of Search ..... 400/577, 545, 187, 611, 400/377, 568, 569, 583.2; 192/28, 12 B, 48.92

[56] References Cited

U.S. PATENT DOCUMENTS

| | | | |
|---|---|---|---|
| 2,659,472 | 11/1953 | Stimson | 400/611 |
| 3,236,348 | 2/1966 | Okcuoglu | 192/28 |
| 3,384,211 | 5/1968 | Placke et al. | 192/28 |
| 3,668,942 | 6/1972 | Landis et al. | 400/568 |
| 3,820,646 | 6/1974 | Lombardi | 400/569 |
| 3,828,911 | 8/1974 | Soderstrom | 400/568 |
| 3,888,340 | 6/1975 | Hoffman | 400/611 |
| 3,963,110 | 6/1976 | Hyland et al. | 400/611 |
| 3,973,662 | 8/1976 | Fulton | 400/568 |
| 3,990,564 | 11/1976 | Crump et al. | 400/229 |
| 4,085,837 | 4/1978 | Takano et al. | 400/568 |

FOREIGN PATENT DOCUMENTS

| | | | |
|---|---|---|---|
| 2943493 | 8/1980 | Fed. Rep. of Germany | 400/568 |

*Primary Examiner*—William Pieprz
*Attorney, Agent, or Firm*—Laurence R. Letson

[57] ABSTRACT

A powered gear driven paper insert and line feed mechanism capable of rotating a platen through one half line spacing increments and which is both power operated and disconnectable for manual operation is disclosed. The platen of the typewriter or printer may be manually rotated using platen or may be electronically rotated by energizing the control magnet, thus engaging the clutch assembly to connect the drive motor to the platen. The clutching assembly is such that two separate clutches are operable to disconnect the platen and gear train from the overall clutch apparatus and also to disconnect the drive motor belt and other related hardware which is driven by the drive motor and belt.

14 Claims, 3 Drawing Figures

PAPER INSERT AND LINE FEED MECHANISM

BACKGROUND OF THE INVENTION

Motor driven line feeds and paper insert mechanisms have existed in the prior art for a considerable period of time in different forms. An example of a device for feeding paper and which utilizes a program control in a printer is U.S. Pat. No. 2,138,646 to Scharr, showing a gear driven powered paper feed mechanism. This device is incapable of disconnection to allow easy manual feeding by hand turning of the platen.

Other examples of paper insert and line feed drive include Aebi, U.S. Pat. No. 3,960,258, which utilizes a clutch arrangement which is disengaged at the end of the desired paper insertion cycle in response to a mechanically activated linkage. In all other respects, the platen is indexed using a conventional pawl and ratchet platen indexing scheme and the gear drive arrangement is only used for paper insert and/or eject.

Another example of a gear driven line feed mechanism is Blum, U.S. Pat. No. 4,031,995, utilizing a gear driven arrangement for rotating a paper platen with a stepping motor while at the same time controlling a paper bail, facilitating paper insertion. The platen is disclosed as connected to the stepping motor and not freely manually rotatable to facilitate positioning of the platen.

It is desirable in printers to be able to electronically control the line feed through a direct motor drive and gear train arrangement to the platen for smooth continuous paper feed and paper insertion as well as for well controlled line feed of multiple increments representing lines, fractions of lines and multiple lines.

At the same time in a typewriter, it is highly desirable to be able to manually insert or position a paper within the typewriter by rotating the platen knob. It is highly undesirable, from a human factors standpoint, to have to overcome the resistance of a significant portion of the typewriter drive train including other elements unrelated to the paper feed drive in order to rotate the platen.

SUMMARY OF THE INVENTION

The drive of a typewriter typically is derived from one motor driving through a plurality of mechanical energy transmission paths. The disclosed drive train for the paper insert and line feed mechanism may be isolated from both the drive motor and the clutch assembly by utilizing two dog clutches in a combined clutch assembly. This allows the drive motor to continue to rotate and power other portions of the typewriter while isolating the greatest portion of the index and paper insert drive chain from the motor during the idling condition. Thus, during the idling condition, there is a minimum number of gears rotating, thereby reducing noise and wear. The disengagement of the second dog clutch isolates the gear train from the clutch assembly. With the clutch assembly isolated from the gear train by the second dog clutch, the latching of the clutch assembly does not prevent hand rotation of the platen.

It is an object of the invention to disconnect the drive motor from the drive train to the platen, while at the same time permitting manual positioning of the platen.

It is another object of the invention to reduce noise by disconnecting the maximum amount of the drive train from the driving pulley receiving forces from the drive motor which, of necessity, rotates during idling condition.

It is a further object of the invention to reduce the load on the motor and thus reduce power consumption during idling conditions.

The advantage of this device over the prior art devices is that it provides a continuous powered gear driven paper insert and line feed mechanism for feeding paper which can be disengaged by means of a clutching assembly to provide for manual positioning of the platen, as well as disengagement from the power source.

Figure 1:
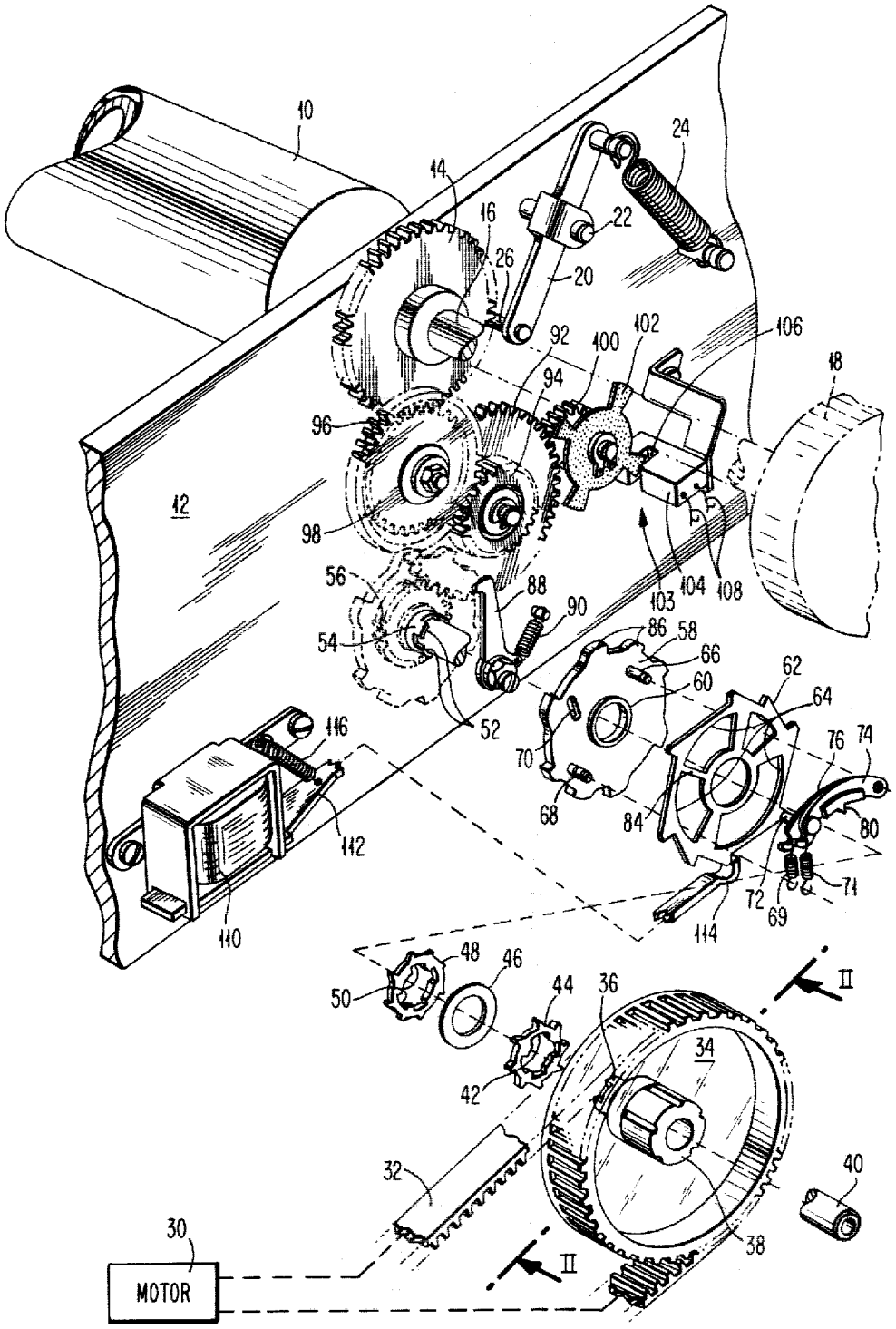
FIG. 1 illustrates a portion of a typewriter including portions of the power frame and platen and having mounted on the frame of the typewriter the drive assembly for the platen.

A more thorough understanding of the operation of this device may be had by referring to the drawings and the detailed description of the invention to follow.

DETAILED DESCRIPTION

Typewriters and printers provide a platen to support the record sheet upon which images are printed and to increment the paper with respect to the writing line. The platen 10 may be rotated by a number of different devices. When it is desirable to rotate the platen in a continuous manner for paper insertion and paper ejection, the most efficient and desirable mechanism is a gear driven platen drive system. Illustrated in FIG. 1, platen 10, supported by side frame 12, is drivably connected with platen drive gear 14 by shaft 16. Platen drive gear 14 is rigidly connected to platen shaft 16 by conventional techniques. Platen shaft 16 is further connected to platen knob 18 for manual rotation of platen 10.

A detenting arm 20 is pivotally supported on post 22 which in turn is mounted on side plate 12. Arm 20 is biased by spring 24 to move detent pin 26 into engagement with the teeth of platen gear 14 to insure consistent positioning of platen 10.

To provide a driving force for the platen gear and the platen, a drive motor 30 drives a timing belt 32 to rotate pulley 34. Pulley 34 is formed in such a way that it has, as a portion thereof, driving splines 36 formed as a part thereof. Likewise, arbor 38 is formed as part of the pulley. Arbor 38 and driving splines 36 rotate with pully 34 about shaft 40.

In driving engagement with driving splines 36 are notches or ways 42 in the interior of clutch ratchet 44. The driving engagement between splines 36 and ways 42 insure that clutch ratchet 44 rotates with pulley 34 as it rotates. Washer 46 acts as a spacer between ratchet 44 and ratchet 48. Clutch ratchet 48 is formed with ways 50 in its interior to interact with splines 52 on bushing 54. Bushing 54 is formed as an extension of gear 56. Bushing 54 supports clutch disc 58 which rotates on the exterior surface of bushing 54. Clutch disk 58 has an upraised bushing surface 60 formed as a part thereof. Release ring 62 is configured such that the inside diameter of the ring is rotationally supported on the bushing surface 60 of disk 58.

Release ring 62 has a plurality of windows or apertures formed around its central axis to accommodate pins 66 and 68 carried by disk 58. Disk 58 also has a slot 70 formed therein to accommodate pin 72 attached by conventional means to pawl 74. Pawl 74 is adjacent to pawl 76. Pawl 74 and 76 are commonly pivotally mounted on pin 66 carried by disk 58. Pin 72 is rigidly attached to pawl 74 and is accommodated by a notch or relief on the underside of pawl 76 to allow pawl 76 to be moveable with respect to pawl 74 and pin 72. Pawl 74 is engageable through tooth 80 with the teeth of ratchet 44.

Figure 2:
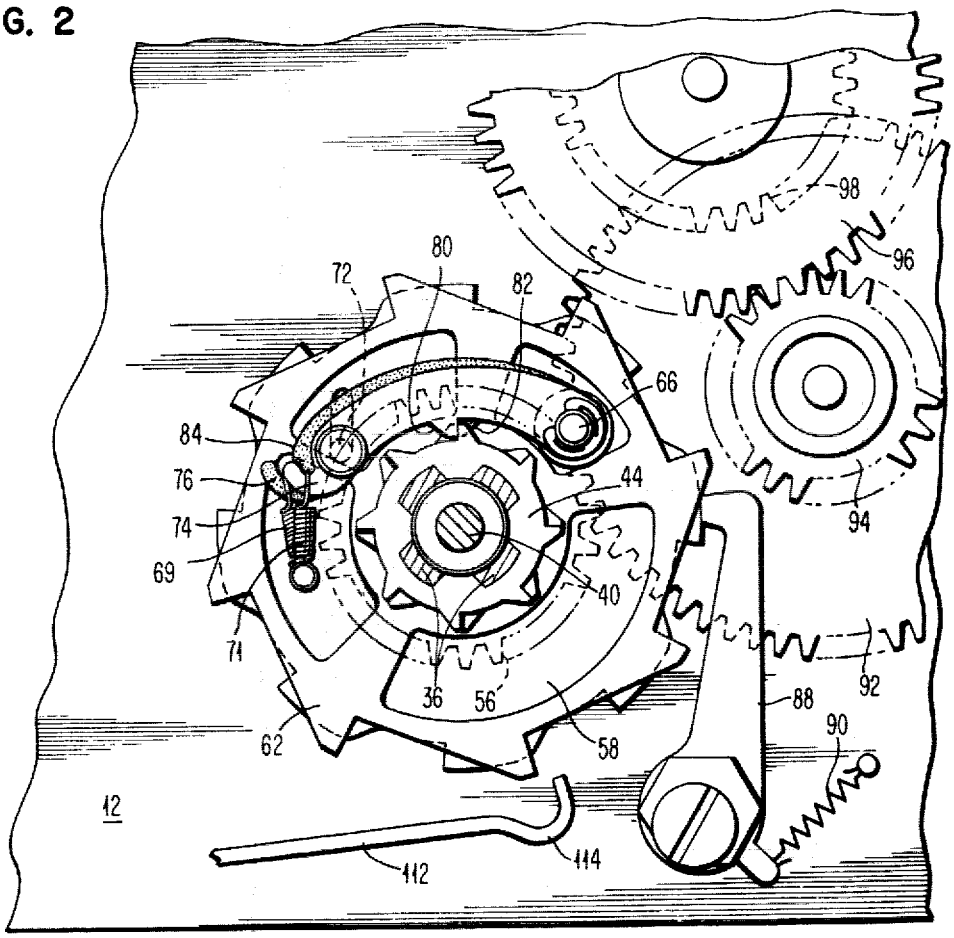
FIG. 2 illustrates an enlarged view of the clutch assembly.

The tooth 82 in FIG. 2 is engageable with the teeth on ratchet 48.

Referring again to FIG. 1, web 84 between apertures 64 of release ring 62 is formed of uniform width so that the edge thereof will interact with pin 72 to cam pin 72 outwardly in slot 70 upon rotation of ring 62 relative to disk 58.

Disk 58 carries on its periphery a plurality of backcheck lugs 86. Backcheck lugs 86 are engageable by backcheck pawl 88 which is spring biased about its mounting by spring 90.

The interconnection between gear 56 and platen gear 14 is accomplished through a speed/displacement reduction gear train comprising gears 92, 94, 96 and 98. Gears 92 and 94 are either formed as a single gear assembly or are joined together to rotate as a fixed unit. Gears 96 and 98 are likewise formed or joined to rotate as a complete unit and constitute the speed/displacement reduction gear train between gear 56 and gear 14. Also deriving rotary motion from gear 94 is gear 100 meshed therewith and drivingly coupled to emitter wheel 102. Emitter wheel 102 is in proximate relationship spacially with emitter/detector 104. Emitter/detector 104 is a light emitting member with a photodetector on the opposite side of the gap 106 so that the blades of emitter wheel 102 will break the light path between the elements of the emitter/detector 104. This device will then generate a waveform signal on lines 108.

The control for the clutch release ring 62 is magnet 110. Magnet 110 will attract armature 112 upon the energizing of the magnet coil 110. The attraction of armature 112 will cause the end of the armature 112 formed as a clutch latch 114 to be withdrawn from engagement with the teeth on the exterior of release ring 62. Upon the release of release ring 62, the ring 62 will rotate counterclockwise, under the influence of springs 69, 71 and pin 72, allowing engagement of teeth 80 and 82 of clutch pawls 74 and 76 with their respective ratchets 44, 48, thereby transmitting rotary motion from pulley 34 into and through the gear train to gear 14.

Figure 3:
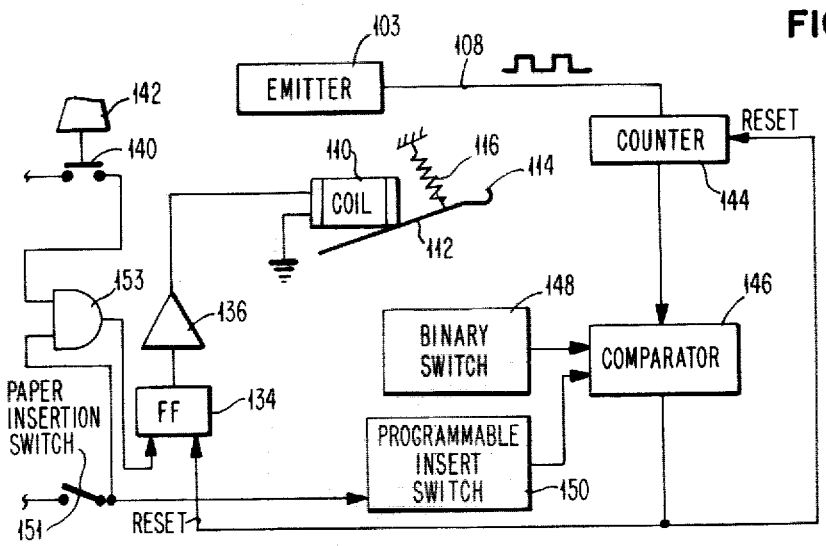
FIG. 3 illustrates a schematic of the controls for operating this paper feed and index mechanism.

Referring to FIG. 3, the circuit to operate the magnet coil 110 and to control its deactivation, upon the appropriate number of emitter pulses having been received by the electronic controls, is disclosed.

Magnet 110 is controlled and energized by a signal from flip-flop 134 passed through an amplifier 136 to secure sufficient current flow to operate magnet 110. The signal to cause the flip-flop 134 to provide an output signal to amplifier 136 is initiated upon the closing of switch 140 in response to the depression of the index keyboard button 142. After the index keyboard button has been depressed and switch 140 closed, the flip-flop 134 will receive a signal and turn on the current to magnet 110, thus causing it to magnetically attract armature 112. When armature 112 is attracted, the clutch assembly shown in FIG. 1 will then engage causing a driving relationship between belt 32 and platen gear 14. As the gear train driving platen gear 14 rotates, emitter wheel 102 in conjunction with the emitter/detector 104 will generate a pulse string illustrated adjacent line 108 in FIG. 3. Line 108 interconnects emitter/detector 104 and counter 144. The pulses of the emitter signal on line 108 will cause counter 144 to convert the pulses into a binary count representing the total count of the emitter pulses generated since the counter 144 has been reset. As each emitter pulse is counted by counter 144, the binary count of counter 144 is provided to comparator 146.

Providing the second input between which comparisons may be made is binary switch 148 which provides a digital representation of the number of the emitter pulses necessary to be counted to effect the desired amount of line feed. As an example, two emitter pulses must be counted for a one line increment of feed, three pulses for one and one-half lines of feed, four pulses for two lines of feed, and six pulses for three lines of feed, thus the binary switch 148 can provide a digital representation of 010 to be loaded into the comparator 146 for a single line feed. Upon the receipt of a count of 010 in binary form from the counter 144 representing the second emitter pulse having been generated by the emitter 103, the comparator 146 will then have both an input from the binary switch 148 of 010 and a count from the counter 144 of 010 and upon the two being the same, an output will be generated by the comparator 146. This output will be provided to the counter 144 to cause the counter 144 to reset in preparation for the next indexing operation and also provide a reset signal to the flip-flop 134. Upon the receipt of the signal from the comparator 146, the flip-flop 134 will then cease to send a signal through amplifier 136, and magnet 110 will be deenergized. Upon the breaking of the circuit providing electrical current to coil 110, spring 116 will act to restore armature 112 to its relaxed non-attracted position and to reinsert tip 114 into engagement with one of the teeth of release ring 62.

The binary switch 148 may conveniently be configured such that this switch may be mounted on the typewriter so that the operator selects the number of lines of line feed desired, 1, 1½, 2, or 3 and automatically in the selecting of the lines to be fed, generates the appropriate binary count to which the counter output will be compared.

An exemplary output of the switch and lines selected are set forth in the table below.

| LINES OF FEED | DIGITAL SWITCH OUTPUT | NO. OF PULSES PULSES REQUIRED |
|---|---|---|
| 1 | 010 | 2 |
| 1½ | 011 | 3 |
| 2 | 100 | 4 |
| 3 | 110 | 6 |

OPERATION

Operation of the line feed mechanism disclosed herein is initiated by depression of index key 142, thus providing a signal through flip-flop 134, amplifier 136 and thereby energizing coil 110 to initiate clutch operation. As the armature 112 in FIG. 1 is attracted to coil 110, the tip 114 is withdrawn from the teeth of release ring 62 allowing release ring 62 to rotate in a counterclockwise direction about its central axis. The force needed to rotate release ring 62 about its central axis is provided by the biased engagement of pin 72 against web 84. The biasing force of pin 72 is provided by spring 71 engaging pawl 74, under tension. As release ring 62 rotates counterclockwise and pin 72 is pulled along slot 70, pawl 74 and tooth 80 act to engage with one of the teeth of ratchet 44 as ratchet 44 is rotating with pulley 34. Tooth 82 on pawl 76 is likewise pulled into engagement with the teeth on ratchet 48.

FIG. 2 illustrates the clutch in a fully engaged condition with the pawl 114 removed from engagement with the teeth on release ring 62. Springs 69 and 71 have pulled pawls 76 and 74, respectively, into a zone of engagement where their teeth 82 and 80, respectively, may engage the ratchets 48, 44, respectively. As springs 69 and 71 act to pull pawls 76 and 74 downward, pin 72 acts against web 84 on release ring 62, thereby rotating release ring 62. As ratchet 44 is rotated by pulley 34 and drives splines 36 as seen in FIG. 1, the tooth of ratchet 44, engaged with tooth 80 on pawl 74 will cause force to be transmitted through pawl 74 to pin 66. Since pin 66 is a common pivot point for both pawls 74 and 76, pin 66 will then act on pawl 76 and through pawl 76 engage tooth 82 with the teeth on ratchet 48 causing ratchet 48 to rotate with pawl 76. As ratchet 48 rotates, the gear 56 is caused to rotate driving gears 92 and 94. Gear 94 is meshed with gear 96 and drives gears 96 and 98. Gear 98 is in turn engaged with platen drive gear 14 which will rotate the platen 10.

As disk 58 rotates, backcheck pawl 88 will cam up over the back sides of the teeth 86 around the periphery of disk 58. Backcheck pawl 88 will prevent disk 58 from rotating in a clockwise direction.

When it is desired to disconnect the clutches from operative engagement, armature 112 is allowed to move pawl tip 114 into engagement with one of the teeth on the exterior of release ring 62 trapping release ring 62 and preventing its further rotation. The inertia of the system will cause the disk 58, pin 66, pawls 74 and 76 to continue to rotate in a counterclockwise direction. Further rotation in the counterclockwise direction with release ring 62 held stationary will cause pin 72 to cam outward on the camming surface of web 84. As the pin 72 moves outward, it acts to extract teeth 80 and 82 from engagement with their respective ratchet wheels 44 and 48. With the outward movement of pin 72 and the counterclockwise movement of disk 58, springs 69 and 71 will extend, thus bringing to a stop disk 58. As disk 58 is brought to a stop, backcheck pawl 88 will engage one of the teeth 86 on the periphery of disk 58 by contraction of spring 90 and thus prevent reverse rotation of disk 58, thereby insuring that teeth 80 and 82 are held out of engagement with ratchets 44 and 48 until reengaged by the release of pawl tip 114 from release ring 62.

As the operator selects the amount of the desired line feed by manipulation of digital switch 148 on the typewriter, the digital switch 148 will cause an outputting of a three digit code to the comparator 146. The binary output of the digital switch 148 corresponds to the binary representations of the number of emitter pulses to be counted by counter 144 during the indexing or line feeding of paper.

Upon the initiation of an index cycle as described earlier and with the clutch assembly operating as described above, the emitter assembly 103 comprising emitter/detector 104 and wheel 102, will generate pulses indicative of the amount of rotation through which the platen 10 has been driven during the cycle up to that point. The pulses are counted by the counter 144 and the binary representation of the cumulative count is fed to comparator 146. Upon the signal provided from counter 144 to comparator 146 being equal to that which is provided by the binary switch 148, the comparator 146 will then provide an electrical output signal.

The electrical output signal from comparator 146 serves as a reset signal for counter 144 to prepare it for the next indexing cycle and as a reset signal for flip-flop 134. The resetting of flip-flop 134 has the effect of deactivating the clutch mechanism in FIG. 3 and stopping the index operation.

The above description has centered around the operation of the line feed capability. For paper insert and paper ejection, the control of the typewriter may be operated as repeated line index cycles by merely holding switch 140 depressed and the flip-flop being constructed in such a way that as long as there is a signal on the set line, the reset is overridden and coil 110 remains energized.

For operator controlled paper insertion or ejection mode, the index button 142 may be held depressed by the operator, thus providing a continuous on or set signal to the flip-flop 134 which in turn will then provide a continuous energization of coil 110. As the counter accumulates counts equal to the binary output of the switch 148, the comparator 146 will signal the reset of flip-flop 134 and counter 144. Flip-flop 134 is constructed such that it will remain set so long as the set signal remains on the set line and override the reset signal. This will continue until switch 140 has opened and comparator 146 has functioned to reset counter 144 and flip-flop 134.

Additionally, for automated paper insert, it is very simple to condition the apparatus so that a predetermined amount of line feed may be accomplished to position the paper at or near the first writing line on a page. This may be accomplished simply by providing a programmable insert switch 150 which will provide a selectable binary output of larger value than binary switch 148 to allow selectable longer feeds when activated by the operator.

For example, the paper insertion switch 151 will cause programmable insert switch 150 to load the comparator 146 with the binary representation of the number 32, thus providing a 16 line feed to bring the paper under the platen and up to predetermined position on the page for character printing. The switch output from switches 140 and 151 are connected to OR block 153 to prevent switch 140 from operating programmable insert switch 150. A larger or smaller binary value may be used as desired for larger or shorter feeds. In all other respects, the system will function exactly as it would under the influence of the index button 142 except that the cycle will be longer due to the larger number loaded into comparator 146.

For ejection of the paper after the typing is completed, index button 142 may be depressed and held depressed to continually cycle the controls through line feed cycles. Inasmuch as the flip-flop 134 will remain set so long as there is a signal on the set line coming from switch 140, the clutch mechanism will remain engaged and the feed will occur in a continuous smooth manner.

It should be recognized that the above embodiment is the preferred embodiment for implementation onto a typewriter having little or no electronic controls and on which there is no microprocessor present.

In the event that this system were to be implemented upon a typewriter or printer having microprocessor control, it would be exceedingly elementary to provide the necessary program controls to the microprocessor to perform the functions of the flip-flop 134, comparator 146 and counter 144. The emitter assembly 103 would provide the emitter pulse train to the microprocessor and the switch 140, binary switch 148 and programmable insert switch 150 would all provide additional inputs to the microprocessor.

We claim:

1. A motor driven indexing system for indexing a platen of a printer comprising:

a motor having a continuous output;

a platen;

a first clutch engageable to transmit said motor output;

a second clutch driven by said first clutch;

a drive train;

said second clutch engageable to transmit the said output of said motor transmitted by said first clutch to said second clutch to said drive train;

said drive train drivingly engaged with said platen, whereby the engagement of said clutches connects drivingly said motor to said platen and disengagement of said clutches frees said motor from driving engagement with said platen and said platen from connection with said first clutch.

2. The indexing system of claim 1 wherein said first and second clutches are dog clutches.

3. The indexing system of claim 2 wherein said dog clutches comprise first and second ratchets and first and second pawls for engagement with said first and second ratchets, respectively, a driving connection between said first and second pawls, and a common release means commonly operative to release both said pawls from said first and second ratchets.

4. A motor driven gear drive for a printer platen comprising a gear drive train drivingly associated with said platen and a clutch assembly for disconnecting said motor from said platen, said clutch assembly comprising:

a first clutch means for disconnecting said gear drive train from said clutch assembly for manual rotatability of the platen;

a second clutch means for disconnecting said motor from said clutch assembly to permit the rotation of said motor while said clutches are in a disengaged condition.

5. The drive of claim 4 wherein said first and second clutch means comprise first and second dog clutches.

6. The drive of claim 5 wherein said second clutch drives said first clutch.

7. The drive of claim 6 wherein said first and second dog clutches comprise first and second dogs interconnected by a common support providing a driving connection therebetween and a common means for controlling said dogs.

8. The drive of claim 7 wherein said means for controlling comprises a release ring common to both first and second clutches.

9. A paper feed device for a typewriter comprising a clutching means, said clutching means comprising:

a rotatable input ratchet;

a rotatable output ratchet;

an engageable dog assembly interconnectable between said ratchets for transmitting rotation of said input ratchet to said output ratchet, control means for controlling the engagement and disengagement of said dog assembly with said ratchets, whereby each of said ratchets may when disengaged rotate independently.

10. The paper feed device of claim 9 wherein said dog assembly comprises a pivot and two dogs pivotally mounted on said pivot and respectively engageable with said ratchets.

11. The paper feed device of claim 9 wherein said control means comprises a common release ring for controlling engagement and disengagement of said dogs with said ratchets.

12. In a motor driven indexing system for indexing a platen of a printer, a motor, a drive train, a platen connected to said train, a first clutch means for disconnecting said motor from said drive train; a second clutch means operable simultaneously with said first clutch means for disconnecting said first clutch means from said drive train; said first and second clutch means comprising a common control means, whereby said platen may be freely rotated without rotating said common control means.

13. The indexing system of claim 12 wherein said common control means comprises an electrically actuated pawl, a release ring engageable by said pawl, said release ring operatively associated with said first and second clutch means to disengage said clutch means upon engagement of said release ring by said pawl.

14. The indexing system of claim 13 wherein common control means comprises:

an electromagnetic coil and armature;

bistable switch means for controlling said coil, having a set and reset condition;

means, manually operable, for operating said bistable switch means to a set condition;

pulse generating means for generating pulses representative of the extent of platen rotation;

counting means for counting said pulses to provide a pulse count;

selector means for providing a binary indication of selected extent of platen rotation desired;

comparator means for comparing said pulse count with said binary indication and, upon equality of said count and said binary indication, outputting a signal;

said signal operative upon said bistable switch means to reset said bistable switch means;

whereby said coil is energized by operation of said manually operable means and deenergized by said comparator means after selected extent of platen rotation.

* * * * *